US008865276B2

(12) United States Patent
Ito et al.

(10) Patent No.: US 8,865,276 B2
(45) Date of Patent: Oct. 21, 2014

(54) WATER-PRESSURE TRANSFER PRINTING FILM

(71) Applicant: Aicello Chemical Co., Ltd., Toyohashi (JP)

(72) Inventors: Katsuhito Ito, Toyohashi (JP); Yasuyoshi Kondo, Toyohashi (JP)

(73) Assignee: Aicello Corporation, Toyohashi (JP)

( * ) Notice: Subject to any disclaimer, the term of this patent is extended or adjusted under 35 U.S.C. 154(b) by 0 days.

(21) Appl. No.: 13/878,370

(22) PCT Filed: Dec. 6, 2012

(86) PCT No.: PCT/JP2012/081639

§ 371 (c)(1),
(2), (4) Date: Apr. 8, 2013

(87) PCT Pub. No.: WO2013/094424

PCT Pub. Date: Jun. 27, 2013

(65) Prior Publication Data

US 2014/0170340 A1 Jun. 19, 2014

(30) Foreign Application Priority Data

Dec. 21, 2011 (JP) ..... 2011-279916

(51) Int. Cl.

| | |
|---|---|
| ***B41M 5/00*** | (2006.01) |
| ***B41M 5/50*** | (2006.01) |
| ***B41M 5/52*** | (2006.01) |
| ***B44C 1/175*** | (2006.01) |
| *B41M 3/12* | (2006.01) |

(52) U.S. Cl.

CPC ..... *B41M 5/508* (2013.01); *B41M 5/52* (2013.01); *B44C 1/175* (2013.01); *B41M 3/12* (2013.01); *B41M 5/502* (2013.01); *B41M 5/5254* (2013.01)

USPC ..... 428/32.18; 428/32.2; 428/32.28

(58) Field of Classification Search

CPC ..... B41M 5/508; B41M 5/52; B41M 5/5254; B41M 5/502; B41M 3/12; B44C 1/175

USPC ..... 428/32.18, 32.2, 32.28

See application file for complete search history.

(56) References Cited

U.S. PATENT DOCUMENTS

| | | | | |
|---|---|---|---|---|
| 2003/0186003 | A1* | 10/2003 | Nakano et al. | 428/32.1 |
| 2003/0203133 | A1* | 10/2003 | Maekawa | 428/32.1 |
| 2008/0258120 | A1* | 10/2008 | Yang | 252/600 |
| 2010/0045760 | A1* | 2/2010 | Kawakami et al. | 347/100 |

FOREIGN PATENT DOCUMENTS

| | | | |
|---|---|---|---|
| JP | 09-300894 | A | 11/1997 |
| JP | 10-071763 | A | 3/1998 |
| JP | 2003-145997 | A | 5/2003 |
| JP | 2005-060636 | A | 3/2005 |
| JP | 2005-280175 | A | 10/2005 |
| JP | 2006-026933 | A | 2/2006 |
| JP | 2006-123392 | A | 5/2006 |
| JP | 2006-264110 | A | 10/2006 |
| JP | 2007-152622 | A | 6/2007 |
| JP | 2009-073184 | A | 4/2009 |
| JP | 2009-214420 | A | 9/2009 |
| WO | WO 2010/061790 | A1 | 6/2010 |

OTHER PUBLICATIONS

International Search Report issued by Japan Patent Office on Jan. 22, 2013 in corresponding PCT patent application No. PCT/JP2012/081639.

The Second Office Action mailed by the State Intellectual Property Office of People's Republic of China on Jul. 9, 2014 in the corresponding Chinese patent application No. 201280003390.7—9 pages.

* cited by examiner

*Primary Examiner* — Betelhem Shewareged

(74) *Attorney, Agent, or Firm* — Knobbe, Martens, Olson & Bear LLP

(57) ABSTRACT

A water-pressure transfer printing film that achieves a smooth image surface on the transfer target by allowing print images such as photographs to be transferred without causing the image quality to degrade, wherein such water-pressure transfer printing film is characterized in that it has at least two layers including an ink-receiving layer and a base layer and that the base layer has a surface roughness Ra of 0.40 μm or less and gloss of 80 or more.

16 Claims, No Drawings

WATER-PRESSURE TRANSFER PRINTING FILM

This application is the U.S. National Phase under 35 U.S.C. §371 of International Application PCT/JP2012/081639, filed on Dec. 6, 2012, which claims priority to Japanese Patent Application No. 2011-279916, filed on Dec. 21, 2011. The International Application was published under PCT Article 21(2) in a language other than English.

TECHNICAL FIELD

The present invention relates to a water-pressure transfer printing film.

BACKGROUND ART

The water-pressure transfer printing method has been known as a means for forming printed patterns, by way of transfer printing, on a formed body having irregular three-dimensional surfaces. To print on a curved surface by water-pressure transfer printing, a transfer printing film comprising a water-soluble or water-swelling film with a printing layer provided on top that constitutes pictures that have been activated with an active agent, is made to float on a water surface with the printing side facing up, and then the transfer target to transfer the pictures to is pressed on it from above and water pressure is utilized to transfer the images on the printing layer to the outer peripheral surface of the transfer target. In general, water-pressure transfer printing is implemented in a water temperature range of 10 to 40° C.

The printing layer requires enough precision to support photographs, etc., and use of on-demand printing methods, the representative of which is inkjet printing, is becoming popular. Unlike in gravure printing, on-demand printing methods eliminate the need to create plates, and therefore keep the cost low. A method is adopted whereby polyvinyl alcohol resin is used for the printing layer to allow for water-pressure transfer printing (Patent Literature 1).

When a polyvinyl alcohol film is made to float on a water surface and to swell, the surface of the film is wrinkled with fine, wavy lines which will be transferred to the surface of the transfer target to be transfer-printed on, creating an undesirable appearance. To address this problem, a method is adopted whereby starch or other polysaccharide or inorganic matter is used as a filler (Patent Literature 2). However, the filler causes the printing layer to become irregular and consequently affects the sharpness of the resulting print images, which is not desirable.

Another point is that, especially in the case of on-demand printing applications, the printed printing layer must be separated from the base layer. Patent Literature 3 adopts a method whereby embossing or matte finish is applied to the base film for greater ease of handling (Patent Literature 3). This improves machinability, but the fine surface irregularities created by embossing or matting affect the surface of the printing layer, which presents a problem that the precision of print images may drop.

Furthermore, one characteristic of the water-pressure transfer printing films used with these methods is that the side of the film opposite the printing side also comes in direct contact with water and thus wrinkles easily. In addition, water flows that occur when the transfer target is pressed onto a water surface cause the film to wrinkle easily and consequently make it difficult to perform reliable water-pressure transfer printing onto the target surface.

BACKGROUND ART LITERATURE

Patent Literature

Patent Literature 1: Japanese Patent Laid-open No. 2003-145997

Patent Literature 2: Japanese Patent Laid-open No. 2007-152622

Patent Literature 3: Japanese Patent Laid-open No. 2005-060636

SUMMARY OF THE INVENTION

Problems to be Solved by the Invention

No water-pressure transfer printing film has been available that provides a smooth image surface by allowing high-definition print images such as photographs to be transferred onto the transfer target without causing the image quality to degrade. Additionally, use of white water-pressure transfer printing film allows for checking of printing precision with ease after printing with an inkjet printer. The object of the present invention is to provide a water-pressure transfer printing film which is a multi-layer film comprising at least two layers including a base layer and an ink-receiving layer, wherein such film has a smooth surface on the ink-receiving layer to achieve high-definition print images and thereby make the transfer target wrinkle-free after transfer printing.

Means for Solving the Problems

The inventor completed the present invention after discovering, through earnest studies, that the aforementioned object could be achieved by the following means:

1. A water-pressure transfer printing film comprising at least two layers including an ink-receiving layer made of polyvinyl alcohol and a base layer, wherein such water-pressure transfer printing film is characterized in that at least a surface of the base layer that contacts the ink-receiving layer has a surface roughness Ra of 0.14 μm or more but less than 0.40 μm, and gloss of 80 or more.
2. A water-pressure transfer printing film according to 1, characterized in that the wet tension of the surface of the base layer is 30 to 46 mN/m.
3. A water-pressure transfer printing film according to 1 or 2, characterized in that the base layer is white.
4. A water-pressure transfer printing film according to any one of 1 to 3, characterized in that the ink-receiving layer is made of polyvinyl alcohol of 1000 to 4000 in polymerization degree and 70 to 99 percent by mol in saponification degree.
5. A water-pressure transfer printing film according to any one of 1 to 4, characterized in that print images are formed by means of inkjet printing.

Effects of the Invention

The water-pressure transfer printing film proposed by the present invention, whose base layer has a surface roughness Ra of 0.40 μm or less and gloss of 80 or more, also suppresses the surface roughness of the ink-receiving layer formed on top of the base layer to achieve high-definition print images. Polyvinyl alcohol solution obtained by solution casting conforms well to the surface irregularities on the cast side of the base layer with good reproducibility, and because the polyvinyl alcohol solution itself has a certain degree of viscosity, irregularities on the surface of the base layer are reproduced as roughness on the air side of the ink-receiving layer. This means that, by adjusting the surface roughness Ra of the base layer to 0.40 μm or less and its gloss to 80 or more, a smooth ink-receiving layer surface can be achieved.

As a result, printing on the surface of the ink-receiving layer will not cause the light to diffuse on the surface of the ink-receiving layer and the images will not appear degraded. Needless to say, if the base layer surface is not smooth, diffusion of light on the ink-receiving layer surface will cause the images to appear degraded.

Also, generally when the surface of the ink-receiving layer is wrinkled, ink will also become winkled and these winkles will remain on the printing surface after printing. Under the present invention, however, the base layer is smooth as mentioned above and therefore the surface of the ink-receiving layer is also smooth, which prevents the surface area of the ink-receiving layer from increasing compared to when the surface has irregularities. This means that, when the film is made to float on a water surface, it contacts water over less area and therefore the film does not swell quickly. As a result, the ink-receiving layer becomes resistant to wrinkling with fine lines.

The present invention provides a water-pressure transfer printing film whose base layer is adjusted to a surface roughness Ra of 0.40 μm or less and gloss of 80 or more, or preferably to a surface roughness Ra of 0.20 μm or less and gloss of 88 or more, to achieve high-definition images on the surface of the ink-receiving layer and reduce the wrinkling of images on the transfer target surface. As long as the wet tension of the surface of the base layer is 30 to 46 mN/m, the ink-receiving layer can be separated from the base layer without causing it to wrinkle, due to the repulsion of the polar groups in the base layer and ink-receiving layer.

Additionally when water-pressure transfer printing is performed on the transfer target, uniform pressure is applied from the ink-receiving layer as the transfer target is pressed onto the printing side of the ink-receiving layer that has been separated from the water-pressure transfer printing film floating on a water surface, and this allows for accurate water-pressure transfer printing by eliminating any influence of water flows.

MODE FOR CARRYING OUT THE INVENTION

After studying in earnest to achieve the aforementioned purpose, the inventor discovered a film comprising at least two layers including an ink-receiving layer and a base layer, where at least one side of the base layer that contacts the ink-receiving layer has a surface roughness Ra of 0.40 μm or less, and gloss of 80 or more, which characterizes the present invention.

The inventor completed the present invention by further discovering that, if the base layer has a wet tension of 30 to 46 mN/m, if the ink-receiving layer is made of polyvinyl alcohol of 1000 to 4000 in polymerization degree and 70 to 99 percent by mol in saponification degree, and if the base material has a smooth surface of 30 to 46 mN/m in wet tension, then such film would function as a water-pressure transfer printing PVA film that can achieve high-definition print images and it would also allow for simple checking of whether or not high-definition print images can be achieved by printing as long as the base layer is white.

(Ink-Receiving Layer)

Under the present invention, preferably the ink-receiving layer is soluble in water or swells in water, and any film material that has been traditionally used as a water-pressure transfer printing film can be selected and used as deemed appropriate.

Candidate material resins include, for example, polyvinyl alcohol resin, dextrin, gelatin, glue, casein, shellac, Arabian gum, starch, protein, polyacrylamide, sodium polyacrylate, polyvinyl methyl ether, methyl vinyl ether-maleic anhydride copolymer, vinyl acetate-itaconic acid copolymer, polyvinyl pyrrolidone, acetyl cellulose, acetyl butyl cellulose, carboxy methyl cellulose, methyl cellulose, hydroxy ethyl cellulose, and sodium alginate, etc. Any one of these resins may be used independently or two or more types may be mixed together. Rubber constituent, such as mannan, xanthan gum, guar gum or the like may be added to the base film.

Among these materials, polyvinyl alcohol is preferred particularly from the viewpoints of production stability, solubility in water and economy. The specific polyvinyl alcohol to be used may be a unmodified PVA, or modified PVA whose main chain is polymerized with one type of monomer or two or more types of monomers of olefin such as ethylene, propylene or the like, acrylate ester, methacrylate ester, maleic acid or salt or ester thereof, or the like.

The polymerization degree, saponification degree and modification type of polyvinyl alcohol, as well as blending ratios of starch and other resins such as rubber, or the like in polyvinyl alcohol, can be changed to adjust, as appropriate, the mechanical strength needed to form a transfer printing layer on the base layer, moisture resistance during handling, speed of softening due to water absorption when the film is made to float on a water surface, time needed for spreading or diffusion in water, and vulnerability to deformation in the transfer printing process, and the like.

In particular, preferably the polymerization degree of polyvinyl alcohol is 1000 to 4000 under the present invention. If the polymerization degree is less than 1000, polyvinyl alcohol may dissolve quickly at the time of water-pressure transfer printing to prevent film application in a covering manner, which may cause functions expected from water-pressure transfer printing not to be demonstrated fully. If the polymerization degree exceeds 4000, on the other hand, the resulting low water solubility of the film may prevent an economic water-pressure transfer printing speed to be achieved.

Further, the saponification degree of polyvinyl alcohol is 70 to 99 percent by mol, or preferably 74 to 88 percent by mol. If the saponification degree of polyvinyl alcohol is less than 70 percent by mol, the water solubility of the film may drop or the film may not dissolve at all, thereby causing the workability of the water-pressure transfer printing process to drop significantly.

The thickness of the ink-receiving layer is preferably 15 to 80 μm, or more preferably 20 to 40 μm.

If the thickness of the ink-receiving layer is less than 15 μm, the film will not have enough strength when the ink-receiving layer is separated from the base layer, causing handling problems. If the thickness of the ink-receiving layer is more than 80 μm, on the other hand, it will take time for the ink-receiving layer to swell, which will also cause the workability of water-pressure transfer printing to drop.

By all means this ink-receiving layer can contain plasticizer to add flexibility to the film. The type of plasticizer is not limited in any way, but it may be polyhydric alcohol plasticizer such as glycerin, diglycerin, triethylene glycol, diethylene glycol, polyethylene glycol or the like, or sugar such as sorbitol, glucose, xylitol or the like. Among others, glycerin is a preferred form of plasticizer. Preferably 0 to 30 parts by weight of plasticizer is added per 100 parts by weight of polyvinyl alcohol. Adding more than 30 parts by weight of plasticizer is not preferable because the plasticizer will bleed from the ink-receiving layer and become sticky.

In addition to the above, filler or anti-blocking agent to prevent mutual blocking of water-pressure transfer printing films, or surface-active agents to improve the dispersibility of any such additive, can be used as deemed appropriate as long as doing so will not affect the smoothness of the PVA film surface.

In addition, polyvinyl alcohol can be mixed with any other water-soluble polymer mentioned above, such as gelatin, casein, Arabian gum, polyvinyl pyrrolidone, pullulan, methyl cellulose, hypromellose, ethyl cellulose, etc. Preferably such water-soluble polymer is added by 20 parts by weight or less per 100 parts by weight of polyvinyl alcohol.

(Base Layer)

Under the present invention, preferably the base layer is made of material offering excellent dimensional stability against changes in environmental temperature and humidity, and it must also have enough flexibility for the water-pressure transfer printing film to withstand printing, cutting and other processes. Size and shape of the base layer are not specified, but if the ink-receiving layer is printed successively, a flexible film may be adopted to ensure the film is transferred easily.

As materials meeting these conditions, polyethylene, polypropylene, PET, polyvinyl chloride, nylon and other resin films, metal foil, paper, etc., can be used. Particularly to facilitate checking of finished quality of printing after the water-pressure transfer printing film has been printed on its surface, any white pigment or other pigment may be added to the base layer or whitish layer may be formed on its surface beforehand.

On the other hand, laminate of polypropylene such as synthetic paper or the like, paper whose surface is covered with any one of various coating layers, or paper whose surface is coated with polypropylene, can be used. If the base material has a Ra, which is an indicator of roughness, of over 0.40 μm, surface irregularities that are likely due to this roughness will also be reproduced on the other side of the PVA film stacked on the base material, or specifically the side of the PVA film not contacting the base material (air side). As a result, patterns due to roughness will appear on the PVA film itself or light will be diffused on the irregular surface of the film to reduce the gloss of achieved images, which will prevent high-quality images from being achieved and this presents a problem that photographic images cannot be transferred onto a three-dimensional transfer target while maintaining their original high image quality.

Furthermore, if the roughness Ra is greater than 0.40 μm, the PVA film may appear cloudy due to surface irregularities. In this case, finished quality of print images cannot be checked thoroughly and the PVA film will have varying thicknesses due to surface irregularities and particularly thin areas will dissolve first, which presents problems such as wrinkling of print images at the time of water-pressure transfer printing and inability to ensure a proper working time.

As explained above, the surface roughness of the base layer affects the roughness of the printing side of the ink-receiving layer and therefore the smoother the base layer for water-pressure transfer printing, the better. In addition, to adjust the surface roughness Ra to 0.40 μm or less and gloss to 80 or more on the side of the base layer where the ink-receiving layer is formed, this surface can be smoothed by a roller, polishing or other means as necessary. It is not that the gloss automatically becomes 80 or more when the surface roughness Ra is 0.40 μm or less; these properties are achieved independently.

Further, the Ra is preferably 0.30 μm or less, or more preferably 0.25 μm or less, or most preferably 0.20 μm or less.

The gloss is preferably 88 or more, more preferably 130 or more, or most preferably 150 or more.

As with the Ra value, reducing the Rz of the base layer surface to lessen the maximum surface irregularities can improve the effects of the present invention. Accordingly, the Rz is adjusted to 3.00 μm or less, or preferably to 2.00 μm or less.

To improve the printability of ink by improving the wet tension of the base layer surface with respect to the ink-receiving layer, the wet tension of the film surface of the base layer can be adjusted to a range of 30 to 46 mN/m. If the wet tension is lower than 30 mN/m, an aqueous solution such as polyvinyl alcohol or the like cannot be applied to form an ink-receiving layer because such aqueous solution would be repelled from the surface of the base layer. If the wet tension is greater than 46 mN/m, on the other hand, strong affinity between the surface of the base layer and ink-receiving layer such as polyvinyl alcohol or the like will prevent the ink-receiving layer such as polyvinyl alcohol or the like from being separated from the base layer at the time of water-pressure transfer printing after printing of images, which presents a problem.

Accordingly, hydrophilization through plasma processing or corona discharge, application of surface treatment agent, etc. can be undertaken, as necessary, to achieve the aforementioned wet tension.

(Manufacturing Method of Water-Pressure Transfer Printing Film)

To manufacture the water-pressure transfer printing film proposed by the present invention, a method to form an ink-receiving layer on a film on which the aforementioned base layer has been formed can be adopted.

The water-pressure transfer printing film proposed by the present invention only needs to be a film comprising at least two layers including an ink-receiving layer and a base layer, and can be manufactured in any way.

For example, material for forming an ink-receiving layer such as polyvinyl alcohol or the like can be dissolved in water and the obtained aqueous solution can be used to form an ink-receiving layer on a base film such as PET, PP or the like constituting the base layer, by using general film forming methods such as spray coating, solution casting or the like, followed by heating and drying of the solution into a film form and layering of the image layer on top by the printing method, to obtain the water-pressure transfer printing film proposed by the present invention. Alternatively, an ink-receiving layer containing polyvinyl alcohol, etc., can be layered onto the base layer by means of heat lamination.

Among others, a preferred method is solution casting of aqueous solution of polyvinyl alcohol onto the base layer, as it can create a film regardless of the polymerization degree of polyvinyl alcohol.

Either way, it is necessary that the ink-receiving layer can be separated from the base layer at the time of water-pressure transfer printing. For this reason, the base layer and ink-receiving layer must have adhesive strength of an appropriate level to permit separation but ensure stable printing on the ink-receiving layer.

Accordingly, the base layer under the present invention must have a wet tension of 30 to 46 mN/m on its surface as a condition for a solution to form an ink-receiving layer such as an aqueous solution of polyvinyl alcohol or the like to be applied, especially when this solution is an aqueous solution. If the wet tension is lower than 30 mN/m, an aqueous solution cannot be applied because an aqueous solution of polyvinyl alcohol would be repelled from the surface of the base layer. If the wet tension is greater than 46 mN/m, strong affinity between the surface of the base layer and polyvinyl alcohol will prevent the polyvinyl alcohol layer from being separated from the base layer at the time of water-pressure transfer printing, which presents a problem.

Preferably the wet tension is 34 mN/m or more and/or 45 mN/m or less.

Since the surface roughness of the base layer affects the roughness of the printing side of the ink-receiving layer, the base layer should be as smooth as possible in any water-pressure transfer printing application. In particular, the base layer should have a Ra of 0.40 μm or less and gloss of 80 or more, where examples meeting these conditions include polyethylene terephthalate, polypropylene, nylon, polystyrene, polyethylene, synthetic paper, etc.

(Ink Used)

The water-pressure transfer printing film under the present invention is used for water-pressure transfer printing after a printing layer is formed on the surface of its ink-receiving layer, and for the ink used for this printing, any known ink can be selected and used.

Such ink may be a solvent-type ink or energy-line hardening ink that hardens under UV light or electron beam.

If the ink is to contain any organic solvent, any of the following solvents can be used: aliphatic hydrocarbons such as pentane, hexane, heptane, octane, etc., or mixture thereof in the form of gasoline, petroleum, benzine, mineral spirit, petroleum naphtha or the like; aromatic hydrocarbons such as benzene, toluene, xylene, cyclohexane, ethyl benzene or the like; halogenated hydrocarbons such as trichloroethylene, perchloroethylene, chloroform, carbon tetrachloride or the like; monohydric alcohol such as methyl alcohol, ethyl alcohol, n-propyl alcohol, isopropyl alcohol, n-butyl alcohol, isobutyl alcohol, amyl alcohol, benzyl alcohol, diacetone alcohol or the like; polyhydric alcohol such as ethylene glycol, propylene glycol, glycerin or the like; ketones such as acetone, methyl ethyl ketone, methyl isobutyl ketone, cyclohexanone, methyl cyclohexanone, isophorone or the like; ethers such as ethyl ether, isopropyl ether, ethylene glycol monomethyl ether, ethylene glycol monoethyl ether, diethylene glycol monomethyl ether, diethylene glycol monoethyl ether, diethylene glycol monobutyl ether, diethylene glycol dibutyl ether, propylene glycol monobutyl ether or the like; acetate esters such as ethyl acetate, propyl acetate, butyl acetate, ethylene glycol monomethyl ether acetate, ethylene glycol monoethyl ether acetate, diethylene glycol monomethyl ether acetate, diethylene glycol monoethyl ether acetate, diethylene glycol monobutyl ether acetate or the like; esters such as butyrate ester or the like; cellosolve; nitrohydrocarbon; nitrile; amine; other acetal; acid; and furan, etc. Of these, preferably aromatic hydrocarbons such as benzene, toluene, xylene or the like should not be used for environmental reasons, etc., and it is preferable, from the viewpoint of solubility in the active agent composition, etc., to use ethyl acetate, propyl acetate, butyl acetate, cello solve, cyclohexanon, ethyl alcohol, isopropyl alcohol, isobutyl alcohol, methyl ethyl ketone, methyl isobutyl ketone, propylene glycol monobutyl ether, propylene glycol, etc. Any one of these solvents may be used alone or two or more types may be combined and used.

If the ink is to contain any water-based solvent, water alone, or a mixed solvent of water and any water-soluble organic solvent or solvents selected from the above, can be used for this solvent.

Among the above inks, organic solvent inks are better suited for water-pressure transfer printing due to their excellent water resistance, although water-soluble solvent inks are also acceptable.

For the colorant contained in the ink, any water-insoluble colorant can be used, for example, inorganic pigments such as titan white, antimony white, lead white, iron black, yellow lead, titan yellow, vermillion, cadmium red, ultramarine blue, cobalt blue, pearl pigment, silver pigments such as aluminum paste or the like, etc; or organic pigments such as carbon black (India ink), benzidine yellow, isoindolinone yellow, polyazo red, quinacridone red, indanthrene blue, phthalocyanine blue or the like.

For the vehicle contained in the ink, any known vehicle can be used, for example, various kinds of oils such as linseed oil, soybean oil, synthetic dry oil or the like; natural resins such as rosin, hardened rosin, rosin ester, polymerized rosin or the like; synthetic resins such as phenol resin, rosin-modified phenol resin, maleate resin, alkyd resin, petroleum resin, vinyl resin, acrylic resin, polyamide resin, epoxy resin, amino alkyd resin, fluororesin or the like; cellulose derivatives such as nitrocellulose, cellulose acetate butylate resin, ethyl cellulose or the like; rubber derivatives such as chlorinated rubber, cyclized rubber or the like; or other such as casein, dextrin or zein, etc.

Various necessary additives may be added to the ink beforehand by considering stability during use after water-pressure transfer printing, etc. To this end, it is preferable to add UV absorbent or photo stabilizer to increase the weather resistance of the printing layer to be transferred onto the transfer target surface of the transfer target.

The UV absorbent may be organic compounds such as benzotriazol, benzophenone, salicylate ester or the like, or inorganic compounds such as zinc oxide, cerium oxide or the like constituted by fine particles of 0.2 μm or less in particle size, while the photo stabilizers may be hindered amine radical trapping agent such as bis-(2,2,6,6-tetramethyl-4-piperidinyl)sebacate or the like, radical trapping agents such as piperidine radical trapping agent or the like.

Such UV absorbent and photo stabilizer can be contained by approx. 0.5 to 10 percent by mass, respectively.

In the case of energy-line hardening ink, any ink can be used that contains colorant such as pigment or the like as desired and also contains any monomer, oligomer, etc., that hardens under irradiation of energy line.

(Forming of Printing Layer)

The aforementioned ink can be used to form a printing layer by means of printing method traditionally adopted for water-pressure transfer printing such as offset printing, letterpress printing, gravure printing or the like, or by means of on-demand printing such as inkjet printing.

If inkjet printing is used, the base film must be white so that the finished print images can be checked. If the base film is not white, checking the printed images for missing areas and mottled colors becomes complex, which is not desirable. In addition, some industrial inkjet printers have a mechanism to use an optical sensor to recognize paper, in which case paper of non-white color cannot be used.

(Active Agent)

Active agent can be applied onto the ink-receiving layer on the water-pressure transfer printing film to cause at least parts of the printing area to dissolve or swell and thereby soften (activate) as appropriate, to maintain the state of whatever is to be printed until it is transferred onto the transfer target. The active agent may be applied on the ink-receiving layer before or after the water-pressure transfer printing film is made to float on a water surface.

The active agent used under the present invention is made of alcohol, ketone, plasticizer and ester with a boiling point of 170° C. or above.

The alcohol may be low-boiling-point alcohol with a boiling point of 70 to 100° C. such as ethyl alcohol (boiling point=78° C.), isopropyl alcohol (boiling point=82° C.), tert-butyl alcohol (boiling point=84° C.), n-propyl alcohol (boiling point=97° C.), 2-butyl alcohol (boiling point=99° C.) or the like, or high-boiling-point alcohol with a boiling point of over 100 to 130° C. such as isobutyl alcohol (boiling point=108° C.), n-butyl alcohol (boiling point=117° C.) or the like, which can be used alone or two or more types of the foregoing can be combined and used. Of these, isopropyl alcohol and isobutyl alcohol are preferred. It is also desirable to use low-boiling-point alcohol with high-boiling-point alcohol, in which case a combination of isopropyl alcohol and isobutyl alcohol is particularly preferable, where the blending ratio by mass is preferably 1:7 to 1:1, or more preferably 1:6.5 to 1:2.

The ketone may be a ketone with a boiling point of 200° C. or below, such as methyl ethyl ketone (boiling point=80° C.), methyl isobutyl ketone (boiling point=116° C.), dibutyl ketone (boiling point=187° C.), diisobutyl ketone (boiling point=168° C.) or the like, among which diisobutyl ketone is preferred.

A preferred choice of plasticizer is phthalate ester. Plasticizer is used to add to the active agent a function to soften the ink on the printing layer.

Preferred choices of phthalate ester include dimethyl phthalate, dibutyl phthalate, dioctyl phthalate, diisooctyl phthalate and other phthalate diester. Among these, dimethyl phthalate and dibutyl phthalate are more preferable, of which dimethyl phthalate is preferred as it not only stabilizes the active state, but also evaporates to an appropriate extent together with other solvent.

The ester with a boiling point of 170° C. or above may be acetate esters such as dibutyl oxalate (boiling point=246° C.), methoxy butyl acetate (boiling point=172° C.) or the like, or glycol ether acetate esters such as butyl carbitol acetate (boiling point=247° C.) or the like. Among these, dibutyl oxalate is preferred.

The content of alcohol in the active agent used with the water-pressure transfer printing film proposed by the present invention is preferably 60 to 90 percent by mass, or more preferably 65 to 80 percent by mass. The content of ester is preferably 0 to 15 percent by mass, or more preferably 5 to 12 percent by mass. The content of ketone is preferably 1 to 20 percent by mass, or more preferably 5 to 12 percent by mass. The content of plasticizer is 1 to 20 percent by mass, or preferably 3 to 18 percent by mass because in this range of plasticizer content there is no problem of parts of ink dissolving quickly to cause the printed text and pictures to run or distort.

The active agent used under the present invention may contain aliphatic hydrocarbon or ether.

The aliphatic hydrocarbon may be heptane, 2-methyl hexane, 3-methyl hexane, 3-ethyl pentane, octane, and isooctane, etc. of which heptane is preferred.

The ester may be butyl cellosolve or isoamyl cellosolve, etc., of which butyl cellosolve is preferred.

The active agent used under the present invention may also contain any of the following resins, for example, which can be added by approx. 1 to 20 percent by mass relative to the solvent. Examples of applicable resins include: halogenated vinyl polymers such as polyvinyl chloride, polyvinyldene chloride or the like; styrene polymers such as polystyrene, polystyrene derivative or the like; vinyl ester polymers such as polyvinyl acetate or the like; unsaturated carboxylic acids such as ester derivative polymer of (meth)acrylate, itaconic acid, crotonic acid, maleic acid, fumaric acid or the like; nitrile derivative polymers of the same or acid amid derivative polymers of the same; thermoplastic resins comprising homopolymer or copolymer of monomer such as N-methylol derivative of the acid amid derivative of the unsaturated carboxylic acids or N-alkyl methylol ether derivative of the same, glycidyl(meth)acrylate, aryl glycidyl ether, vinyl isocyanate, aryl isocyanate, 2-hydroxy ethyl-(meth)acrylate, 2-hydroxy propyl-(meth)acrylate, ethylene glycol-mono (meth)acrylate or the like; polyamide resin; polyester resin; phenol resin; melamine resin; urea resin; epoxy resin; diaryl phthalate resin; silicate resin; thermosetting resins such as polyurethane resin or the like or modified resins or initial condensation products thereof, or natural resins, rosin or derivative thereof, natural or synthetic rubbers, petroleum resin, cellulose acetate butylate (CAB), cellulose resins such as nitrocellulose or the like, and alkyd resin, etc.

(Water-Pressure Transfer Printing Process)

The water-pressure transfer printing film proposed by the present invention supports any widely used water-pressure transfer printing device, where any transfer target may be used as long as it is a substance on which patterns, etc., are formed by water-pressure transfer printing and has any conventionally used three-dimensional shape. Material of the transfer target is not limited in any way, and may be desired material such as resin, metal, wood, or the like.

When the base material is separated from the water-pressure transfer printing film on which images have been printed, and the ink-receiving layer alone is made to float on a water surface with its printing side facing up, the PVA film absorbs water and when the film becomes sufficiently soft, the water-pressure transfer printing film on a water surface, onto which active agent has been sprayed, is pressed down into the water by the transfer target. As a result, the ink-receiving layer that has dissolved and/or swollen is applied, in a covering manner, to and transferred onto the transfer target due to water pressure. When the transfer target is taken out of the water and rinsed with copious water, the remaining PVA is removed from the surface and the transfer of images onto the transfer target is now complete.

(Effects of the Present Invention and Mechanism for Achieving these Effects)

When water-pressure transfer printing is performed using the water-pressure transfer printing film under the present invention, use of a base material whose roughness Ra is 0.4 μm or less and whose gloss is 80 or more provides a film characterized by minimum surface irregularities and high gloss also on the surface of the PVA or other film constituting the printing layer on the base material, or especially the layer on the side that becomes the surface after water-pressure transfer printing. Accordingly, images printed on this surface of PVA, etc., can also be printed by water-pressure transfer at high gloss. Minimum surface irregularities of the PVA film result in a uniform dissolution time of the PVA film, which makes it possible to implement water-pressure transfer printing offering stable quality and high image quality by simple steps.

As for formation of the ink-receiving layer, a solution to form an ink-receiving layer such as polyvinyl alcohol or the like, which is used in solution casting, etc., conforms well with good reproducibility to the surface irregularities on the cast side of the base layer, and because the solution itself has a certain degree of viscosity, the irregularities of the base layer surface are reflected in the roughness of the ink-receiving layer surface. This is probably why, when the air side of the printing layer is printed on, light diffuses slightly on the surface of the printing layer and the images appear degraded as a result.

Also, surface irregularities of the base layer increase the surface area of the polyvinyl alcohol film, which in turn increases the area that contacts water when the film is made to float on a water surface and thereby quickens the swelling of the film, thus causing the film to wrinkle easily with fine lines.

This is considered the reason why wrinkling remains on the surface of the film obtained by transfer printing. For this reason, keeping the surface roughness Ra of the base layer to 0.40 μm or less makes the images on the surface of the printing layer high-definition and provides a water-pressure transfer printing film that generates less wrinkling of the images on the transfer target surface.

As long as the wet tension of the surface of the base layer is 30 to 46 mN/m, the printing layer can be separated from the base layer with ease due to the repulsion of polar groups in the base layer and printing layer.

Based on the above, the present invention provides a water-pressure transfer printing film having a base layer and an ink-receiving layer, and this film, if the surface roughness Ra of the base layer is 0.40 μm or less, allows water-pressure transfer printed images of high image quality to be achieved in a simple manner by means of inkjet printing.

EXAMPLES

The present invention is explained more specifically below using examples. However, it should be noted that the present invention is not at all limited to these examples. Among all possibilities, the following shows examples of two-layer water-pressure transfer printing film compositions, each constituted by a print-receiving layer made of polyvinyl alcohol of 2000 in polymerization degree and 88 percent by mol in saponification degree, which is layered onto a base layer to a thickness of 30 μm.

(Evaluation of Samples)

Evaluation of Surface Roughness

Ra and Rz were measured using a roughness meter (Handysurf E-35A manufactured by Accretech) in an ambience of 23° C., 50% RH. Gloss was measured using a gloss meter (Gloss Meter VG7000 manufactured by Nippon Denshoku Industries).

Evaluation of Separability

A PVA-based print-receiving layer, which was layered onto an A4-size base material, was pulled by hand to be separated, to evaluate the degree of separation.

Separability is classified into two levels according to the criteria below:

The print-receiving film can be separated from the base material by hand without resistance—○

Other than the above (The print-receiving film is already separated before touching or cannot be separated, or the separated PVA film has visible streaks)—X Evaluation of Solubility A 10-cm×10-cm square of the PVA film separated from the base material of the water-pressure transfer printing film was made to float on a water surface to visually observe whether the print-receiving layer would dissolve within 60 seconds after swelling.

Solubility is classified into two levels as follows:

The print-receiving layer does not dissolve within 60 seconds—○

The print-receiving layer dissolves within 60 seconds—X

Evaluation of Transfer-Printed Image

The print-receiving layer already printed with an A4-size photographic image was made to float on a water surface and, after 60 seconds, the top face of the film was water-pressure transfer printed onto a white formed body made of ABS.

Thereafter, the image was visually observed for wrinkling.

Condition of wrinkling is classified into two levels as follows:

The image is not wrinkled—○

The image is wrinkled—X

Overall Judgment Criteria for Water-Pressure Transfer Printing Film

Separability is "○" solubility is "○" and transferred image is "○"—○

Separability is "○" solubility is "○" and transferred image is "X"—X

Separability is "○" solubility is "X," and transferred image is "○"—X

Separability is "X," solubility is "○" and transferred image is "○"—X

Separability is "○" solubility is "X," and transferred image is "X"—X

Separability is "X," solubility is "○" and transferred image is "X"—X

Separability is "X," solubility is "X," and transferred image is "○"—X

Separability is "X," solubility is "X," and transferred image is "X"—X

An ink-receiving layer of 30 μm in thickness, constituted by partially saponified polyvinyl alcohol of 2000 in polymerization degree and 88.0 percent by mol in saponification degree (manufactured by Japan Vam & Poval) was layered onto each of various base layers to obtain a multi-layer film. Thereafter, a PX-series inkjet printer (PX-G930 manufactured by EPSON) was used to print wood grain patterns on the ink-receiving layer with pigment ink, to produce a water-pressure transfer printing film. For the transfer target, a formed PVC pipe of 20 mm in diameter and 15 cm in length was used. The print-receiving layer of this film was made to float on a water surface of 30° C. in temperature with the printing side facing up, and after 100 seconds, active agent was sprayed onto the print image side, after which the transfer target was gently thrust into the water from above the film to transfer an image.

TABLE 1

| | Base material | | | | | Evaluation | | | |
|---|---|---|---|---|---|---|---|---|---|
| | Name | Ra | Rz | Gloss | Wet tension | Separability | Solubility | Transferred image | Overall judgment |
| Examples | Yupo XAA-1091/ Yupo Corporation | 0.3 | 1.9 | 88 | 34 | ○ | ○ | ○ | ○ |
| | Oper G22MDP/ Nippon Paper Papylia | 0.14 | 1.39 | 82 | 46 | ○ | ○ | ○ | ○ |
| | PET: FE2001/ Futamura Chemical | 0.15 | 1.64 | 169 | 45 | ○ | ○ | ○ | ○ |
| | OPP: P2108/ Toyoshina Film | 0.21 | 1.95 | 148 | 38 | ○ | ○ | ○ | ○ |

TABLE 1-continued

| | Base material | | | | | Evaluation | | | |
|---|---|---|---|---|---|---|---|---|---|
| | Name | Ra | Rz | Gloss | Wet tension | Separability | Solubility | Transferred image | Overall judgment |
| Comparative examples | Yupo GFG/ Yupo Corporation | 0.27 | 1.5 | 55 | 62 | ○ | X | X | X |
| | Oper F12MDP/ Nippon Paper Papylia | 1.03 | 11.9 | 10 | 48 | X | X | X | X |
| | Yupo LAR 95/ Yupo Corporation | 0.39 | 4.3 | 11 | 58 | X | X | X | X |
| | Oper FFW130/ Nippon Paper Papylia | 0.68 | 9.15 | 9 | 39 | X | ○ | X | X |
| | Byna Sheet/ Fujimori Kogyo | 1.55 | 11.6 | 18 | Below 30 | X | X | X | X |

As shown in the table, examples using Yupo XAA-1091, Oper G22MDP, Futamura Chemical's FE2001 PET and Toyoshina Film's P21080PP demonstrated good (○) separability, solubility and transferred image as evidenced by their Ra and gloss values within the scope of the present invention.

However, although the example with Yupo GFG produced a Ra value within the scope of the present invention, its gloss value was outside the scope, indicating good separability but unacceptable solubility and transferability.

It was also found that, where both the Ra value and gloss value were outside the scope of the present invention, separability, solubility and transferred image were all unacceptable.

These results show that the present invention can demonstrate its effects of enabling smooth, reliable water-pressure transfer printing and achieving good transfer image, especially by adopting a base material whose surface Ra and gloss are within specified ranges.

What is claimed is:

1. A water-pressure transfer printing film comprising at least two layers including an ink-receiving layer made of polyvinyl alcohol and a base layer, said ink-receiving layer being water-soluble or -swelling and adapted to be separated from the base layer in water-pressure transfer printing, wherein at least a surface of the base layer that contacts the ink-receiving layer has a surface roughness Ra of 0.14 μm or more but less than 0.40 μm, and gloss of 80 or more.

2. A water-pressure transfer printing film according to claim 1, characterized in that a wet tension of the surface of the base layer is 30 to 46 mN/m.

3. A water-pressure transfer printing film according to claim 1, characterized in that the base layer is white.

4. A water-pressure transfer printing film according claim 1, characterized in that the ink-receiving layer is made of polyvinyl alcohol of 1000 to 4000 in polymerization degree and 70 to 99 percent by mol in saponification degree.

5. A water-pressure transfer printing film according to claim 1, characterized in that print images are formed by means of inkjet printing.

6. A water-pressure transfer printing film according to claim 2, characterized in that the base layer is white.

7. A water-pressure transfer printing film according to claim 2, characterized in that the ink-receiving layer is made of polyvinyl alcohol of 1000 to 4000 in polymerization degree and 70 to 99 percent by mol in saponification degree.

8. A water-pressure transfer printing film according to claim 3, characterized in that the ink-receiving layer is made of polyvinyl alcohol of 1000 to 4000 in polymerization degree and 70 to 99 percent by mol in saponification degree.

9. A water-pressure transfer printing film according to claim 6, characterized in that the ink-receiving layer is made of polyvinyl alcohol of 1000 to 4000 in polymerization degree and 70 to 99 percent by mol in saponification degree.

10. A water-pressure transfer printing film according to claim 2, characterized in that print images are formed by means of inkjet printing.

11. A water-pressure transfer printing film according to claim 3, characterized in that print images are formed by means of inkjet printing.

12. A water-pressure transfer printing film according to claim 4, characterized in that print images are formed by means of inkjet printing.

13. A water-pressure transfer printing film according to claim 6, characterized in that print images are formed by means of inkjet printing.

14. A water-pressure transfer printing film according to claim 7, characterized in that print images are formed by means of inkjet printing.

15. A water-pressure transfer printing film according to claim 8, characterized in that print images are formed by means of inkjet printing.

16. A water-pressure transfer printing film according to claim 9, characterized in that print images are formed by means of inkjet printing.

* * * * *